US005283953A

United States Patent [19]

Ikuta et al.

[11] Patent Number: 5,283,953

[45] Date of Patent: Feb. 8, 1994

[54] ROTARY DRY SHAVER

[75] Inventors: Toshio Ikuta; Masao Tanahashi; Takeshi Shiba, all of Hikone, Japan

[73] Assignee: Matsushita Electric Works, Ltd., Osaka, Japan

[21] Appl. No.: 929,656

[22] Filed: Aug. 12, 1992

[30] Foreign Application Priority Data

Nov. 26, 1991 [JP] Japan ..... 3-311079
Nov. 26, 1991 [JP] Japan ..... 3-311080

[51] Int. Cl.[5] ..... B26B 19/14
[52] U.S. Cl. ..... 30/43.6; 30/43.5
[58] Field of Search ..... 30/43.4, 43.5, 43.6, 30/DIG. 2, 346.51

[56] References Cited

U.S. PATENT DOCUMENTS

| | | | |
|---|---|---|---|
| 2,565,828 | 8/1951 | Vivie | 30/43.6 |
| 2,824,367 | 2/1958 | McWilliams | 30/41.5 |
| 3,636,626 | 1/1972 | Zuurveen | 30/43.5 |
| 3,844,033 | 10/1974 | Yonkers | 30/43.6 |
| 4,001,932 | 1/1977 | Herrick | 30/43.5 |
| 4,077,120 | 3/1978 | Herrick et al. | 30/43.5 |
| 4,137,629 | 2/1979 | Yamazaki | 30/43.5 |

FOREIGN PATENT DOCUMENTS

| | | | |
|---|---|---|---|
| 0074684 | 3/1983 | European Pat. Off. . | |
| 0179515 | 4/1986 | European Pat. Off. . | |
| 2031275 | 1/1971 | Fed. Rep. of Germany . | |
| 3518455 | 11/1985 | Fed. Rep. of Germany . | |
| 8403705 | 7/1986 | Netherlands . | |
| 0659379 | 4/1979 | U.S.S.R. | 30/43.6 |
| 784909 | 10/1957 | United Kingdom . | |
| 2061168 | 5/1981 | United Kingdom | 30/43.6 |

*Primary Examiner*—Richard K. Seidel
*Assistant Examiner*—Hwei-Siu Payer
*Attorney, Agent, or Firm*—Kenyon & Kenyon

[57] ABSTRACT

A rotary dry shaver includes an outer shearing foil supported on a head frame and an inner cutter holder having a center axis and carrying a plurality of inner blades in hair shearing engagement with the outer shearing foil. The inner cutter holder is operatively connected to a rotary drive shaft of an electric motor so as to be driven thereby to rotate about the center axis. The outer shearing foil is held movable in the direction of the center axis relative to the head frame, while the inner cutter holder is movable along the center axis relative to the rotary drive shaft so as to be floatingly supported thereby. The dry shaver is characterized in that the outer shearing foil is connected to the inner cutter holder by means of a pin extending along the center axis such that the outer shearing foil and the inner cutter holder are movable together along the center axis relative to the head frame as well as the rotary drive shaft. Whereby contact pressure between the inner blades and the outer shearing foil can be kept substantially at a constant level irrespective of the relative movement of the outer shearing foil to the head frame.

12 Claims, 8 Drawing Sheets 47
42
41
44
40
43
45
46

52
51
53
33
34
32
31
30

80
86
87
81
85
84

83
94
91
93
92
14
15
13

ROTARY DRY SHAVER

BACKGROUND OF THE INVENTION

1. Field of the Invention

The present invention is directed to a rotary dry shaver, and more particularly to a rotary dry shaver having a floating outer shearing foil capable of being depressed when pressed against the skin of a user.

2. Description of the Prior Art

In a typical rotary dry shaver, as shown in FIGS. 8A, an inner cutter holder 140 is provided to carry a plurality of inner blades 141 (although only one of which is shown for simplicity) and is driven by a rotary shaft 112 to rotate about an axis thereof with the inner blades 141 kept in shearing engagement with a perforated outer foil 150 which is supported at its periphery to a head frame 130. Since the outer shearing foil 150 is required to be thin in order to enable a close shaving, the outer shearing foil 150 is likely to flex when pressed against the skin of a user during the shaving. In this type of the dry shaver, a problem is encountered when the outer shearing foil 150 is depressed at its center portion, as shown in FIG. 8B. That is, in the absence of such deformation of the foil 150, the whole inner blades 141 can be placed in constant shearing engagement with the foil 150 over the entire length of the blade 141, as shown in FIG. 8A. However, as the foil 150 is depressed to thereby lower a corresponding end portion of the inner blade 141, the other end portion is spaced from the foil 150 to leave a gap therebetween, which results in worsening cut sharpness with attendant noise increase and even in failing to continue the shaving. To avoid the problem, it has been proposed in a prior art rotary dry shaver, as disclosed U.S. Pat. No. 3,636,626 to use a pin which extends from a like drive shaft for supporting the center portion of the outer shearing foil. The pin is connected through a spring to the drive shaft so as to support the foil with a suitable spring bias. Thus, the center portion of the foil is urged outwardly to resist deformation which would otherwise cause the above problem. In this prior rotary dry shaver, the other portion of the foil is held in shearing engagement with inner blades which are carried on cutter holders. The cutter holders are supported to the drive shaft through springs in such a manner that the other portion of the outer shearing foil is floatingly supported by means of those springs. However, with this structure in which the outer foil is supported on the inner cutter holders which in turn supported through the springs to the drive shaft, there arises another problem in that when the outer foil is depressed against the skin of a user, the depression force acts firstly and directly on the engagement between the outer foil and the corresponding inner blades to thereby increase contact pressure therebetween. Such variation of the contact pressure is detrimental to the cut sharpness and therefore the contact pressure should be maintained at a desired level without being influenced by the depression of the outer shearing foil.

SUMMARY OF THE INVENTION

The above problems have been eliminated in the present invention which provides an improved rotary dry shaver with a floating outer shearing foil. The rotary shaver in accordance with the present invention comprises an outer shearing foil supported on a head frame and an inner cutter holder having a center axis and carrying a plurality of inner blades in hair shearing engagement with the outer shearing foil. The inner cutter holder is operatively connected to a rotary drive shaft of an electric motor so as to be driven thereby to rotate about the center axis. The outer shearing foil is held movable in the direction of the center axis relative to the head frame. The inner cutter holder is also movable along the center axis relative to the rotary drive shaft so as to be floatingly supported thereby. The rotary dry shaver of the present invention is characterized in that the outer shearing foil is connected in the direction of the center axis to the inner cutter holder by means of a pin extending along the center axis such that the outer shearing foil and the inner cutter holder are movable together along the center axis relative to the head frame as well as the rotary drive shaft, respectively. Whereby contact pressure between the inner blades and the outer shearing foil can be kept substantially at a constant level irrespective of the relative movement of the outer shearing foil to the head frame. As the outer shearing foil is axially connected to the inner cutter holder by means of the axially extending pin, the outer shearing foil can be axially supported or backed up by the inner cutter holder and can be therefore well prevented from being deformed. Consequently, the outer shearing foil can be depressed without causing partial deformation which would otherwise cause uneven shearing engagement between the outer shearing foil and the inner blades. Moreover, when the outer shearing foil is depressed as a consequence of being pressed against the skin of a user, the inner cutter holder is correspondingly displaced by means of the pin in such a manner as to avoid the inner blades being depressed directly from the outer shearing foil, enabling to assure constant optimum contact pressure between the outer shearing foil and the inner blades.

Accordingly, it is a primary object of the present invention to provide an improved rotary dry shaver in which the outer shearing foil and the inner blades are allowed to be displaced or depressed without causing substantial variation in contact pressure therebetween, thereby assuring optimum cutting sharpness.

The inner cutter holder comprises a floating joint which is floatingly supported to the rotary drive shaft to be movable relative thereto along the center axis together with the inner cutter holder. The pin has its upper end fixed to the center of the outer foil and depends therefrom to extend through the inner cutter holder and abuts at its lower end against a top end of the floating joint so that when the outer foil is depressed, the pin acts to lower the floating joint which in turn lower the inner cutter holder to substantially the same extent as the outer shearing foil is lowered, whereby assuring constant optimum contact pressure between the outer shearing foil and the inner blades on the inner cutter holder. The pin has its lower end rounded which is supported on a rounded recess formed in the top end of the floating joint to achieve a point contact between the pin and the joint so as not to add any substantial load or resistance to the rotation of the floating joint and therefore the inner cutter holder, assuring smooth rotation of the inner blades, yet connecting the outer shearing foil axially to the floating joint, which is therefore another object of the present invention.

In a preferred embodiment, the outer shearing foil supported on the head frame is configured to include a center foil and a peripheral foil surrounding the center foil in a concentric relation thereto. Associated with the center and peripheral foils there are provided a center holder having a center axis and carrying a plurality of center inner blades in hair shearing engagement with said center foil and a peripheral holder surrounding the center holder in a concentric relation thereto and carrying a plurality of peripheral inner blades in hair shearing engagement with the peripheral foil. The center and peripheral holders are connected commonly to a rotary drive shaft of an electric motor so as to be driven thereby to rotate about the center axis. The outer shearing foil is held movable in the direction of the center axis relative to the head frame in such a manner that the center foil is movable independently of the peripheral foil. The center and peripheral holders are connected to the rotary drive shaft respectively through a floating joint and a fixed joint secured to the drive shaft in the direction of the center axis. The floating joint is floatingly supported on the fixed joint by means of a spring interposed therebetween in order to floatingly support the center holder relative to the drive shaft while biasing it upwardly toward the center foil. The center foil is connected to the floating joint by means of a pin extending through the center holder along the center axis such that the center foil and the inner cutter holder are movable together along the center axis relative to the head frame as well as the rotary drive shaft, thereby keeping contact pressure between the inner blades on the center holder and the center foil substantially constant irrespective of the relative movement of the center foil to the head frame. The center foil is linked to the peripheral foil in such a manner that the center foil is axially movable independently of the peripheral foil to a limited extent within which the contact pressure between the center foil and the inner blades on the center holder is maintained at an optimum level. When the center foil is moved or depressed further beyond the limited extent, the peripheral foil is depressed together with the center foil. Although such further depression is not likely in a normal shaving operation, but the lowering movement of the peripheral foil is advantageous for protecting the overall outer foil from being damaged when pressed forcibly against the user's skin. The inner blades on the peripheral holder are spring biased toward the peripheral foil, which in turn effects to floatingly support the peripheral foil. In this consequence, as the peripheral foil is depressed, the contact pressure between the peripheral foil and the corresponding inner blades will vary as opposite to that between the center foil and the corresponding inner blades. The inner blades on the center holder are spring biased toward the center foil to give an optimum contact pressure therebetween which can be free from the depression of the center foil as described in the above.

These and still other objects and advantageous features of the present invention will become more apparent from the following description of the embodiment when taken in conjunction with the attached drawings.

DETAILED DESCRIPTION OF THE EMBODIMENT

Figure 1:
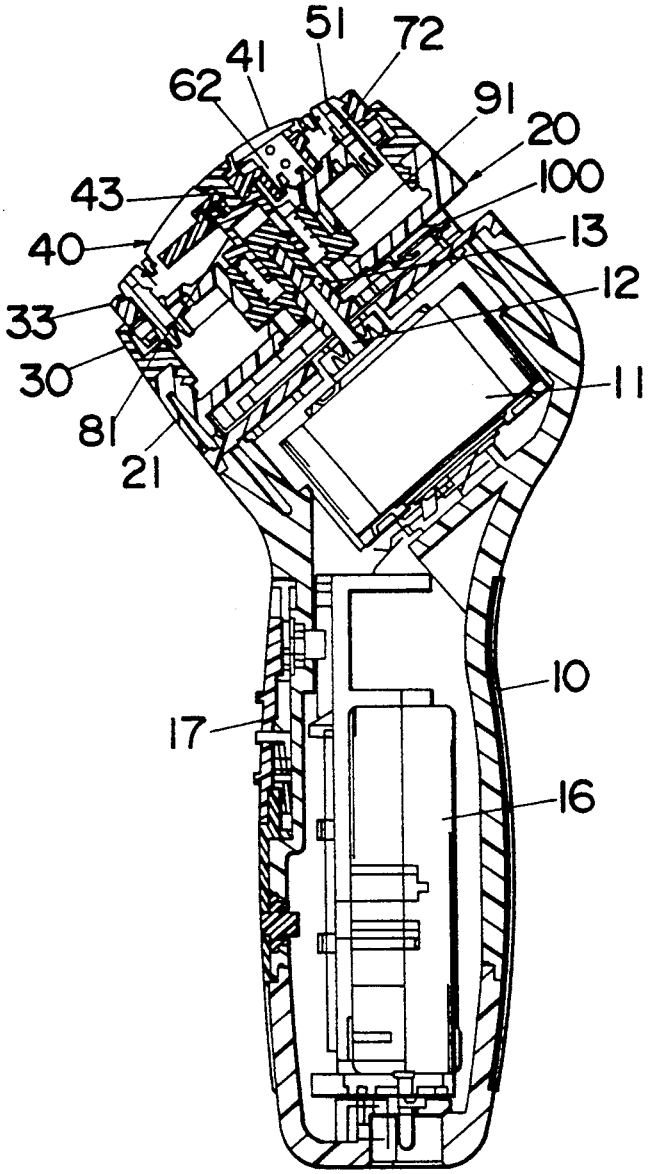
FIG. 1 is a vertical section of a rotary dry shaver in accordance with a preferred embodiment of the present invention.

Referring now to FIG. 1, a rotary dry shaver in accordance with a preferred embodiment of the present invention comprises a cutter head 20 mounted on top of a housing 10 in the form of a hand grip. The housing 10 incorporates an electric motor 11 and a rechargeable battery 16 for energization of the motor 11. A switch handle 17 is provided on the housing 10 for turning on and off the motor 11. The cutter head 20 comprises a cylindrical base barrel 21 fixed on top of the housing 10 and a circular head frame 30 carrying an outer shearing foil 40. The head frame 30 is screwed into an upper opening of the base barrel 21 to accommodate therein an inner cutter assembly which carries a plurality of inner blades and is driven by the motor to rotate with the inner blades in sliding hair shearing engagement with the outer foil 40.

Figure 3:
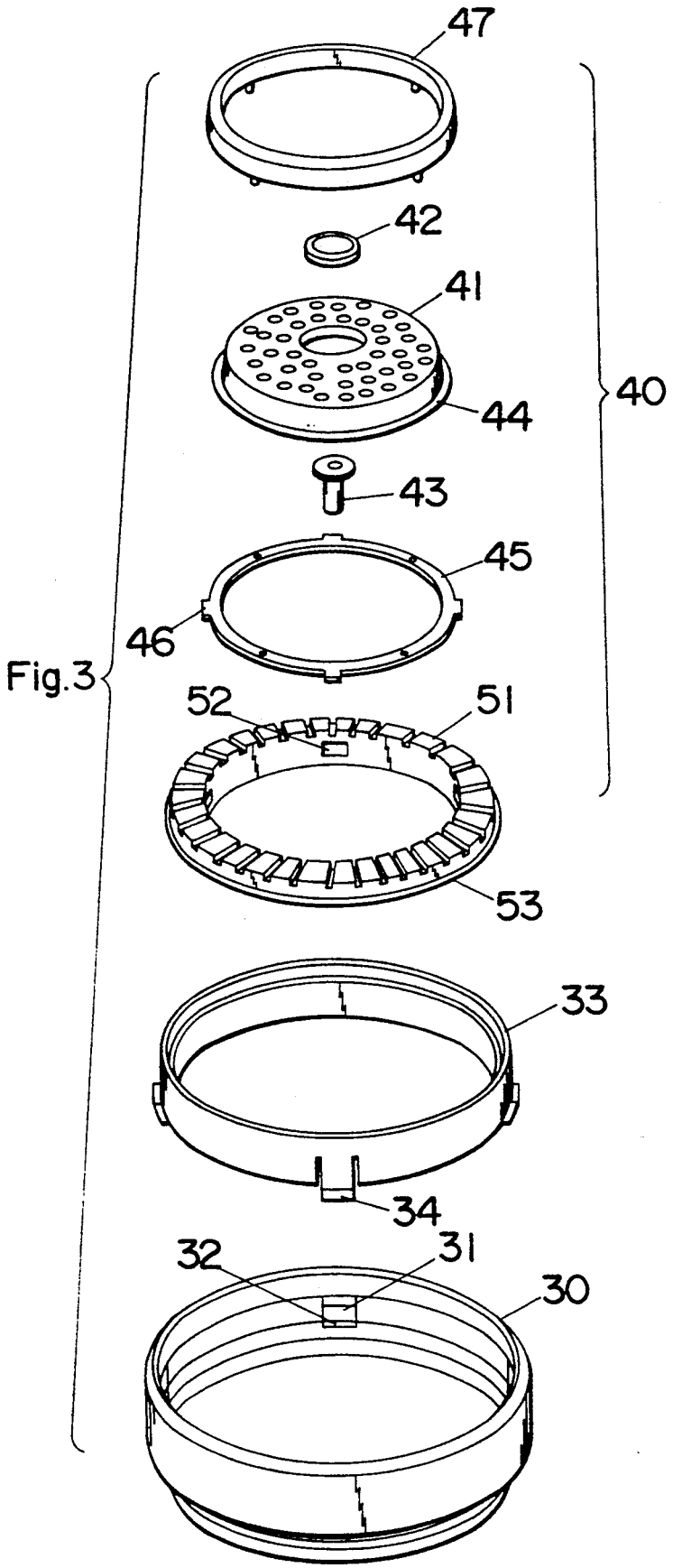
FIG. 3 is an exploded perspective view of a head frame of the cutter head.

As shown in FIG. 3, the outer shearing foil 40 comprising a circular center foil 41 with a number of perforations and an annular peripheral foil 51 with a number of circumferentially spaced slits. The center foil 41 is shaped into a slightly convexed configuration and is fitted in its top center opening with a pad 42 from which a center pin 43 depends integrally in alignment with a rotary drive shaft 13 secured to an output rotor shaft 12 of the motor 11. The center pin 43 is integrally fixed to the pad 42 by means of welding. Integrally formed around the center foil 41 is a flange 44 which is sandwiched between a lower metal ring 45 with circumferentially spaced tabs 46 and an upper plastic ring 47. The peripheral foil 51 surrounds the center foil 41 with the plastic ring 47 exposed therebetween and is shaped to have an inverted U-shape cross-section with a pair of opposed legs. The center foil 41 is connected to the peripheral foil 51 by inserting the tabs 46 of the metal ring 45 loosely into holes 52 formed in one of the legs. Each of the holes 52 has a vertical dimension which is greater than the thickness of the tab 46 such that the center foil 41 is allowed to move vertically relative to the peripheral foil 51. The peripheral foil 51 is secured at its outer flange 53 to a retainer ring 33 which is in turn supported to the head frame 30 by engagement of resilient hooks 34 of the retainer ring 33 into corresponding recesses 31 formed in the interior of the head frame 30. The engagement of the hooks 34 into the recesses 31 are such that the retainer ring 33 is movable together with the peripheral foil 51 vertically relative to the head frame 30 to some extent. A stopper 32 is formed at the bottom of each recess 31 to restrict the downward movement of the peripheral foil 51. Thus, the peripheral foil 51 is allowed to vertically displace relative to the head frame 30, while the center foil 41 is allowed to vertically displace relative to the peripheral foil 51 such that the center foil 41 is firstly displaced to a certain extent independently of the peripheral foil 51, after which the center foil 41 and the peripheral foil 51 are displaced together to some extent as the center foil 41 is pressed against the user's skin.

Figure 2:
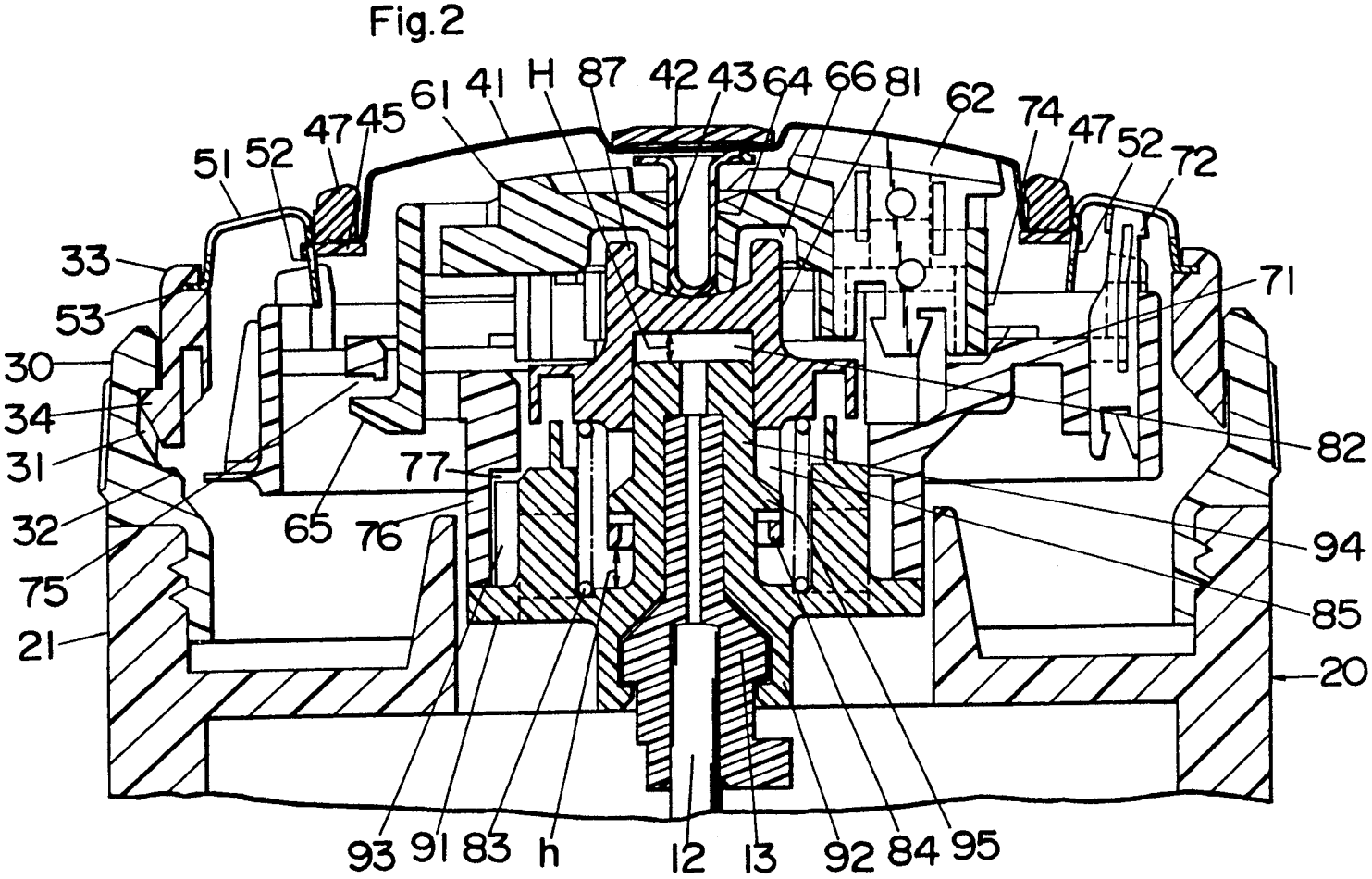
FIG. 2 is an enlarged vertical section of a cutter head of the shaver.
Figure 4:
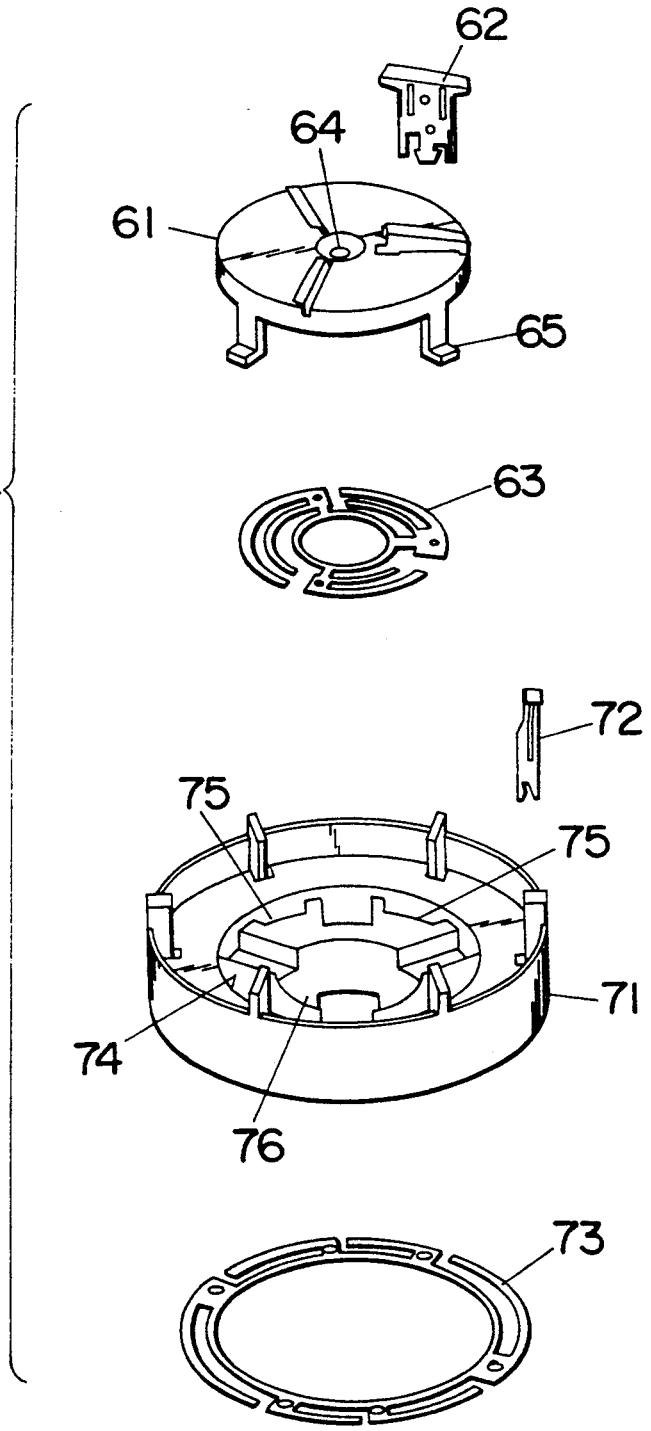
FIG. 4 is an exploded perspective view of an inner cutter assembly with a center holder and a peripheral holder.

As shown in FIG. 4, the inner cutter assembly comprises a center holder 61 of a generally disk-shaped configuration and a peripheral cutter holder 71 which are separately formed and coupled such that the center holder 61 is rotatable together with the peripheral holder 71 but is vertically movable relative to the peripheral holder 71. The center holder 61 has a center axis in concentric relation to the rotary drive shaft 13 and carries three circumferentially spaced inner blades 62 extending radially. The inner blades 62 are coupled to a spring member 63 fitted on the underside of the holder 61 to be spring-biased toward the center foil 41 for providing an optimum contact pressure therebetween. Formed in the center of the holder 61 is a vertical hole 64 through which the pin 43 extends from the center foil 41. The center holder 61 is also provided with depending hooks 65 for coupling with the peripheral holder 71 so that these two holders 61 and 71 are assembled into a unitary structure to be readily assembled as a single unit to the drive shaft 13. Centrally formed in the underside of the center holder 61 around the hole 64 is a pair of diametrically opposed catches 66, as shown in FIG. 2, which are coupled to the drive shaft 13 so as to be driven thereby to rotate about the center axis.

The peripheral holder 71 surrounds the center holder 61 in concentric relation and carries six circumferentially spaced inner blades 72 which are coupled to a spring member 73 fitted on the underside of the holder 71 to be spring-biased toward the peripheral foil 51 for providing a contact pressure therebetween. The peripheral holder 71 is formed with a center opening 74 into which the lower end of the center holder 61 is fitted. Formed around the center opening 74 are a set of circumferentially spaced holes 75 into which the hooks 65 depending from the center holder 61 are engaged, respectively in such a manner that the center holder 61 is movable along the center axis thereof relative to the peripheral holder 71. A cylinder 76 integrally depends from the center of the peripheral holder 71 for driving connection to the drive shaft 13 through a joint assembly so, as will be discussed hereinafter. For this purpose, the cylinder 76 is formed in its lower end with notches 77, as shown in FIG. 2.

Figure 5:
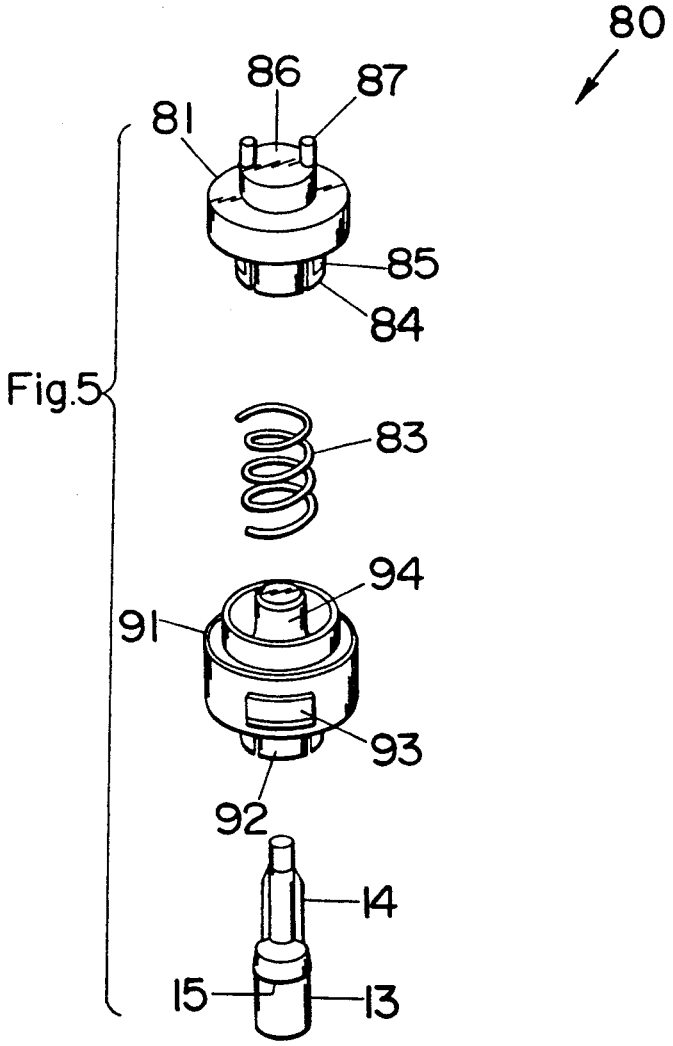
FIG. 5 is an exploded perspective view of a combination joint for driving connection between a rotary drive shaft of an electric motor and the center and peripheral holders.

As shown in FIG. 5, the joint assembly so comprises a fixed joint 91 secured to the rotary drive shaft 13 and a floating joint 81 connected to the fixed joint 91 in such a manner as to be rotatively fixed but axially movable relative thereto. The rotary drive shaft 13, which is fixed to the output rotor shaft 12 of the motor 11, projects into a bore in the fixed joint 91 with splines 14 on the drive shaft 13 engaged into corresponding grooves (not shown) in the fixed joint 91 and with latches 92 at the lower end of the fixed joint 91 engaged with a shoulder 15 formed at the lower portion of the drive shaft 13. Thus, the fixed joint 91 is rotatable with the drive shaft 13 and is axially fixed thereto. Formed around the fixed joint 91 is a pair of projections 93 which are engaged into the notches in the cylinder 76 depending from the peripheral holder 71 in order to drive the peripheral holder 71 to rotate. The floating joint 81 is coupled to the fixed joint 91 with a hub 94 on the fixed joint 91 slidable fitted into a bore 82 in the bottom of the floating joint 81, as shown in FIG. 2, so that the floating joint 81 is concentric with and is axially slidable relative to the fixed joint 91. A coil spring 83 is interposed between the floating joint 81 and the fixed joint 91 to bias the floating joint 81 axially upwardly. Integrally depending from the floating joint 81 are anchor legs 84 with openings 85 into which stoppers 91 on the hub 94 engaged, as shown in FIG. 2, so that the floating joint 81 is rotatively secured to the fixed joint 91 to be rotatable therewith. The stoppers 95 act to retain the floating joint 81 on the fixed joint 91 so that they are handled as the one piece joint assembly 80. As shown in FIG. 2, the floating joint 81 is allowed to axially displaoe relative to the fixed joint 91 by a maximum distance H defined between the bottom of the bore 82 and the top end of the hub 94. The maximum distance H is set to be shorter than a distance h defined between the anchor legs 84 and the bottom of the fixed joint 91 such that even when the floating joint 91 is moved to its lowermost position at which the top end of the hub 94 abuts against the bottom of the bore 82, the anchor legs 84 are kept free from receiving any corresponding forces which would otherwise disengage the floating joint 81 from the fixed joint 91. Formed at the top center of the floating joint 81 is a rounded recess 86 which receives on its bottom the rounded lower end of the pin 43 depending from the center foil 41 and extending through the center holder 61. A pair of diametrically opposed studs 87 projects on the periphery of the recess 86 so as to engage into the catches 66 in the center holder 61 for driving the center holder 41 to rotate. Thus, the center holder 61 is driven to rotate together with the peripheral holder 71 but is axially movable relative thereto. It is noted here that the center foil 41 is lifted to its normal position, as seen in FIG. 2, by the bias of the floating joint 81, i.e., the coil spring 83. Thus, the center foil 41 is floatingly supported by the floating joint 81 to be axially movable relative to the peripheral foil 51 and the head frame 30. As shown in FIG. 2, when the center foil 41 receives no depression force during the shaving operation, the center holder 61 is urged by the floating joint 81 to its uppermost position where the rounded recess 86 of the floating joint 81 abuts against the lower end of the pin 43 of the center foil 41 with the center foil 41 lifted relative to the peripheral foil 51. Thus, the center holder 61 is held at this position by the contact between the pin 43 and the floating joint 81 so that the inner blades 62 on the center holder 61 are kept in shearing engagement with the center foil 41 at the optimum contact pressure solely determined by the bias of the spring member 63 At this condition, the peripheral foil 51 is kept lifted relative to the head frame 30 by the bias acting on the inner blades 72 on the peripheral holder 71 by the spring member 73 and the inner blades 72 is kept in shearing engagement with the peripheral foil 51 at a contact pressure determined by the bias of the spring member 73.

Figure 6:
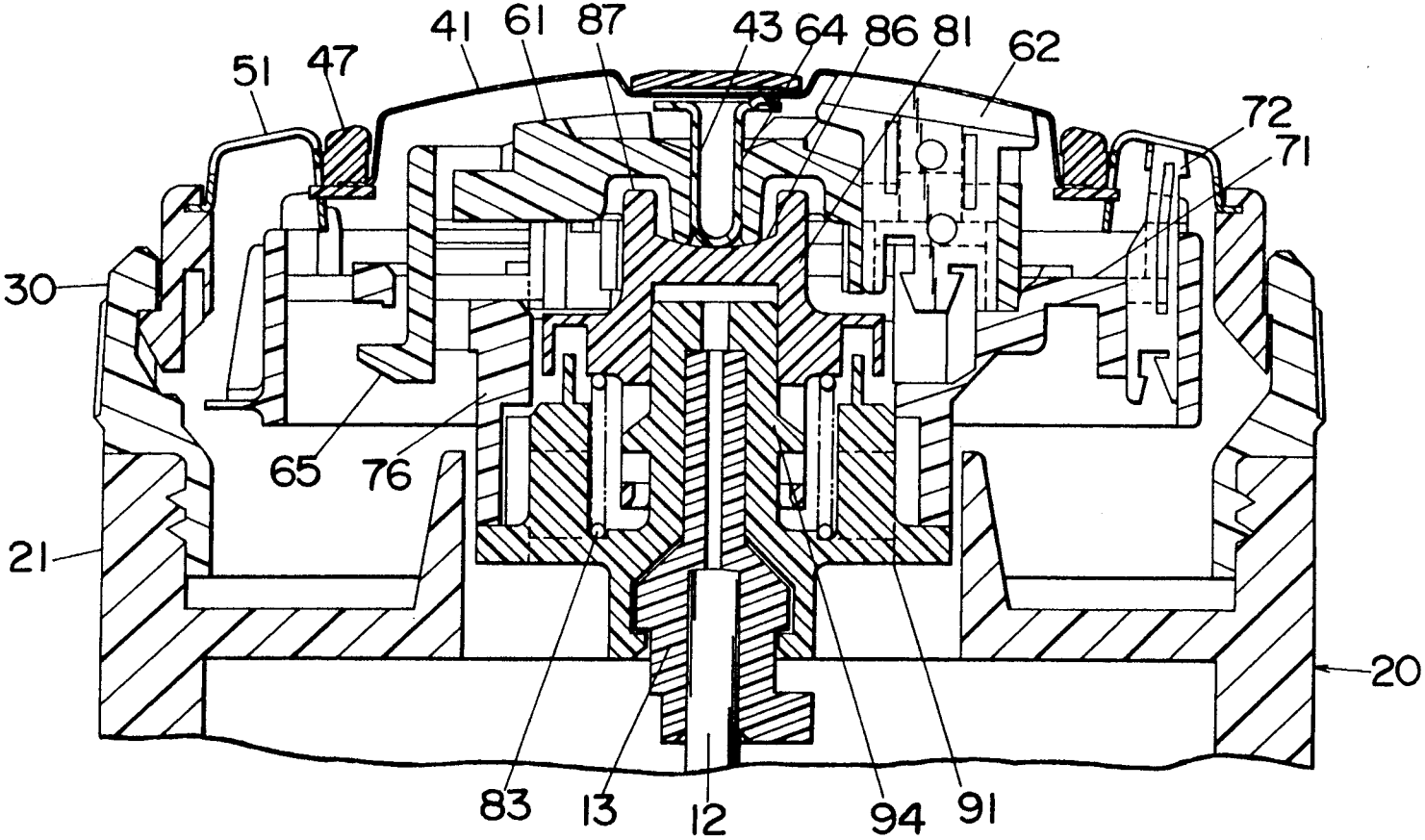
FIGS. 6 and 7 are enlarged vertical sections illustrating conditions in which the outer shearing foil is depressed slightly and greatly, respectively.

As shown in FIG. 6, when the center foil 41 is depressed to some extent, i.e., lowered in relation to the peripheral foil 51, the pin 43 pushes the floating joint 81 downwardly and therefore lowers the center holder 61 to the same extent. Consequently, no depression force is applied directly from the center foil 41 to the inner blades 62 on the center holder 61 so that the inner blades 62 are kept in shearing engagement with the center foil 41 at invariable contact pressure therebetween. At this condition, the peripheral foil 51 is still lifted relative to the head frame 30 by the bias acting on the inner blades 72 by the spring member 73 and the inner blades 72 is kept in shearing engagement with the peripheral foil 51 at the contact pressure determined by the spring member 73. Also at this condition, the lowered center foil 41 are cooperative with the still lifted peripheral foil 51 to present a continuously curved surface, as opposed to the condition of FIG. 2.

Figure 7:
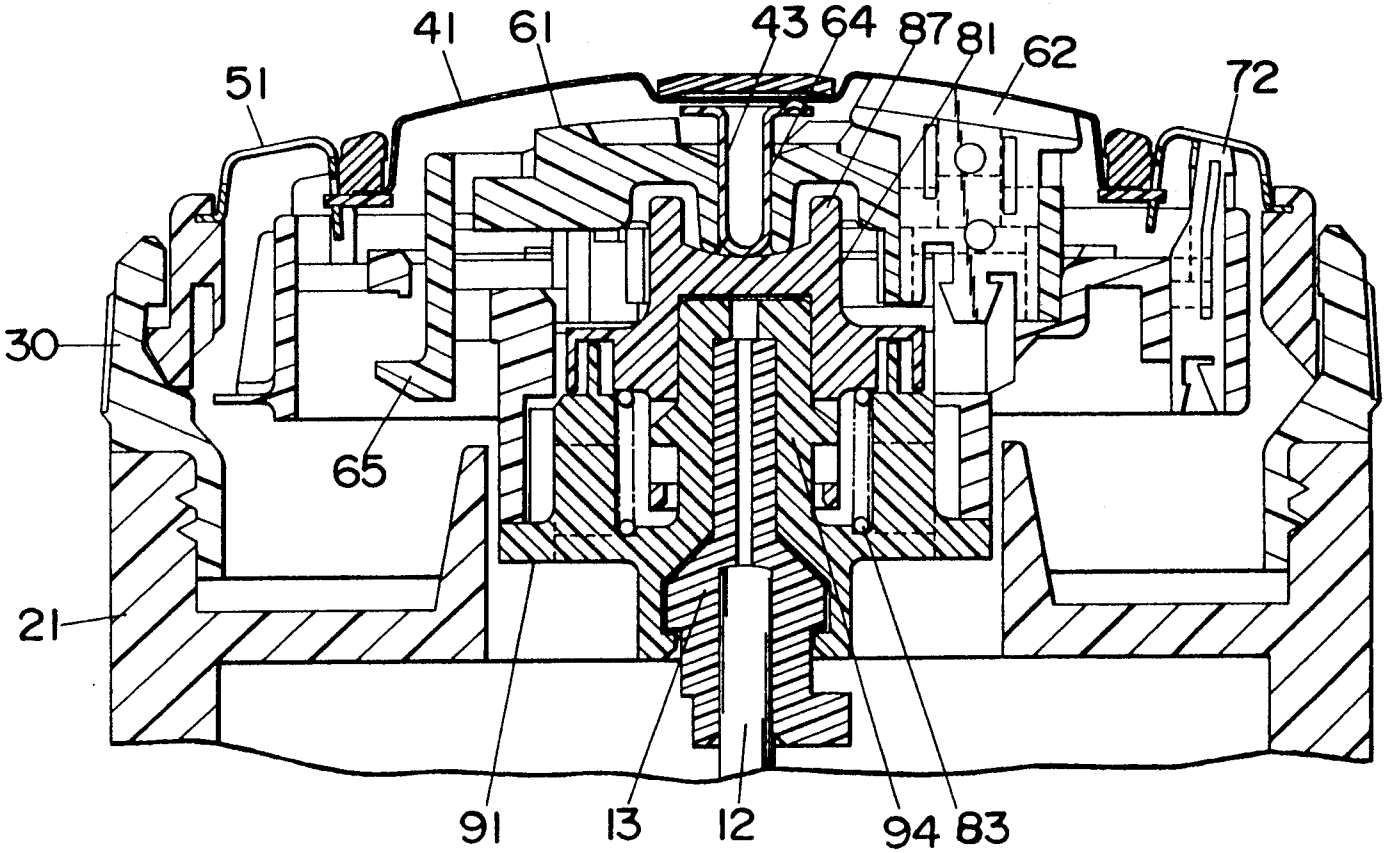
Figure 8A:
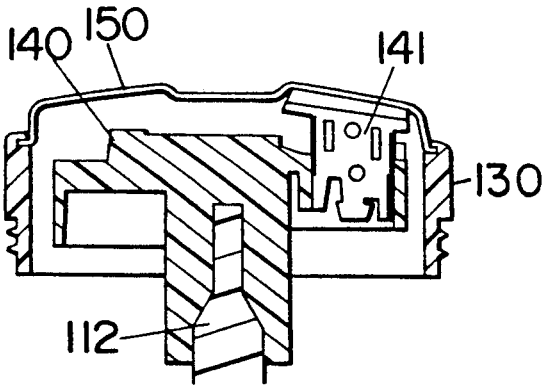
Fig.8A (PRIOR ART)
FIGS. 8A and 8B are schematic views illustrating the problem of a prior art rotary dry shaver.
Figure 8B:
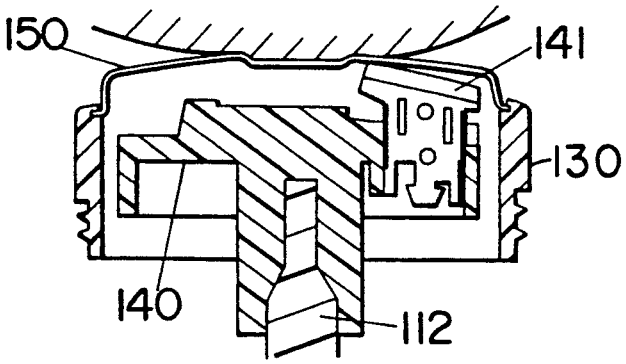
Fig.8B (PRIOR ART)

As shown in FIG. 7, when the center foil 41 is further depressed, the pin 43 pushes the floating joint 81 down to its lowermost position where the floating joint 81 abuts against the fixed joint 91 and at the same time the center foil 41 pulls the peripheral foil 51 downward through the connection at 44 to 47 to lower the peripheral foil 51 relative to the head frame 30 against the bias acting on the inner blades 72. Also at this condition, the center holder 61 is lowered to the same extent as the center foil 41 so that there arises no substantial variation in the contact pressure between the inner blades 62 and the center foil 41, thus maintaining an optimum cut sharpness at the center foil 41. While, on the other hand, the peripheral foil 51 is pressed against the inner blades 72 on the peripheral holder 71 at a correspondingly increased contact pressure.

As apparent from the above, as the center foil 41 is pressed against the user's skin, the center foil 41 is only depressed or lowered and is not deformed due to the axial connection between the center foil 41 to the floating joint 81. Moreover, since the Center holder 61 is capable of being lowered to the same extent as the center foil 41 is depressed without causing direct application of the depressing force from the center foil 41 to the inner blades 62 of the center holder 61, the inner blades 62 can be kept in shearing engagement with the center foil 41 at invariable contact pressure irrespective of the depression of the center foil 41, thereby assuring optimum cut sharpness.

Turning back to FIG. 1, the cutter head 20 includes a trimmer block 100 with trimmer blades. The trimmer block 100 is normally held within the cutter head 20 and is allowed to project outwardly for trimming operation, at which condition, the trimmer blade comes into engagement with an eccentric cam portion (not shown) of the drive shaft 12 so as to be driven thereby to reciprocate.

What is claimed is:

1. In a rotary dry shaver comprising:

an outer shearing foil supported on a head frame;

an inner cutter holder having a center axis and carrying a plurality of inner blades in hair shearing engagement with the outer shearing foil, said inner cutter holder being operatively connected to a rotary drive shaft of an electric motor so as to be driven thereby to rotate about the center axis, said outer shearing foil being held movable along said center axis relative to said head frame, and said inner cutter holder being held movable along said center axis relative to said rotary drive shaft so as to be floatingly supported thereby and;

a floating joint which is floatingly supported on the rotary drive shaft to be movable relative thereto along the center axis together with the inner cutter holder, said dry shaver being characterized in that said outer shearing foil is connected in the direction of the center axis to said inner cutter holder by means of a pin extending along said center axis such that the outer shearing foil and the inner cutter holder are movable together along said center axis relative to the head frame as well as said rotary drive shaft, said pin having a rounded end which is supported on a rounded recessed top surface of said floating joint, thereby keeping contact pressure between the inner blades and the outer shearing foil substantially constant irrespective of the relative movement of the outer shearing foil to the head frame.

2. A rotary dry shaver as set forth in claim 1, wherein said pin depends from said outer foil and abuts against said top surface of said floating joint.

3. A rotary dry shaver as set forth in claim 1, wherein said inner cutter holder carries spring means for biasing the inner blades on the cutter holder toward said outer shearing foil to provide a desired contact pressure therebetween.

4. A rotary dry shaver comprising:

an outer shearing foil supported on a head frame and including a center foil and a peripheral foil surrounding the center foil in a concentric relation thereto;

a center holder having a center axis and carrying a plurality of center inner blades in hair shearing engagement with said center foil;

a peripheral holder surrounding said center holder in a concentric relation thereto and carrying a plurality of peripheral inner blades in hair shearing engagement with said peripheral foil;

said center and peripheral holders being operatively connected commonly to a rotary drive shaft of an electric motor so as to be driven thereby to rotate together about said center axis, said outer shearing foil being held movable in the direction of said center axis relative to said head frame in such a manner that said center foil is movable relative to said peripheral foil;

said center and peripheral holders being connected to said rotary drive shaft respectively through a floating joint and a fixed joint secured to said drive shaft in the direction of said center axis, said floating joint being floatingly supported on said fixed joint by means of a spring interposed therebetween in order to floatingly support said center holder relative to said drive shaft;

said center foil being connected to said floating joint by means of a pin extending through said center holder along said center axis such that said center foil and said center holder are movable together along said center axis relative to the head frame as well as said rotary drive shaft, thereby keeping contact pressure between the inner blades on the center holder and the center foil substantially constant irrespective of the relative movement of the center foil to the head frame.

5. A rotary dry shaver as set forth in claim 4, wherein said pin extends from said center foil and abuts against a top end of said floating joint.

6. A rotary dry shaver as set forth in claim 5, wherein said pin has a rounded end which is supported on a rounded recess formed in the top end of said floating joint.

7. A rotary dry shaver as set forth in claim 4, wherein said center foil is supported to said head frame through said peripheral foil in such a manner that the center foil is movable relative to said peripheral foil in the direction of said center axis.

8. A rotary dry shaver as set forth in claim 4, wherein said center holder carries spring means for biasing the inner blades on the center holder toward said center foil to provide a desired contact pressure therebetween and wherein said peripheral holder carries spring means for biasing said inner blades on the peripheral holder toward said peripheral foil to provide a desired contact pressure therebetween.

9. In a rotary dry shaver comprising:

an outer shearing foil supported on a head frame;

an inner cutter holder having a center axis and carrying a plurality of inner blades in hair shearing engagement with the outer shearing foil;

an electric motor having a rotary drive shaft rotating about a rotation axis thereof;

said inner cutter holder being operatively connected to said rotary drive shaft of said electric motor so as to be driven thereby to rotate about said center axis, said outer shearing foil being held movable along said rotation axis and movable for limited angular displacements with respect to said rotation axis relative to said head frame, and said inner cutter holder being held movable along said rotation axis relative to said rotary drive shaft so as to be floatingly supported thereby and;

a floating joint which is floatingly supported on the rotary drive shaft to be movably relative thereto only substantially along the rotation axis together with the inner cutter holder;

said dry shaver being characterized in that said outer shearing foil is connected in the direction of the center axis to said inner cutter holder such that the outer shearing foil and the inner cutter holder are movable together along said rotation axis relative to the head frame as well as said rotary drive shaft, said inner cutter holder being supported to said floating joint by means of spherical contact means, said spherical contact means including a pin having a rounded end which is supported on a rounded recessed top surface of said floating joint whereby said inner cutter holder is allowed to move together with said outer shearing foil for limited angular displacements with respect to said rotation axis while said floating joint is permitted to move substantially only along said rotation axis, thereby keeping contact pressure between the inner blades and the outer shearing foil substantially constant irrespective of the relative movement of the outer shearing foil to the head frame.

10. A rotary dry shaver as set forth in claim 9, wherein said pin extends through a hole in said inner cutter holder such that said outer shearing foil is movable together therewith for limited angular displacements with respect to said rotation axis.

11. A rotary dry shaver as set forth in claim 9, wherein said pin extends through a hole in said inner cutter holder such that said outer shearing foil is movable together therewith for limited angular displacements with respect to said center axis.

12. A rotary dry shaver as set forth in claim 9, wherein said inner cutter holder carries spring means for biasing the inner blades on the cutter holder toward said outer shearing foil to provide a desired contact pressure therebetween.

* * * * *